US005154152A

United States Patent [19]

Yamane et al.

[11] Patent Number: 5,154,152

[45] Date of Patent: Oct. 13, 1992

[54] FUEL CONTROL DEVICE OF AN ENGINE

[75] Inventors: Koichi Yamane; Koji Nishimoto, both of Himeji, Japan

[73] Assignee: Mitsubishi Denki Kabushiki Kaisha, Tokyo, Japan

[21] Appl. No.: 774,958

[22] Filed: Oct. 11, 1991

[30] Foreign Application Priority Data

Nov. 6, 1990 [JP] Japan ..... 2-301544

[51] Int. Cl.[5] ..... F02D 41/10

[52] U.S. Cl. ..... 123/492; 123/488; 123/493

[58] Field of Search ..... 123/478, 480, 488, 492, 123/493

[56] References Cited

U.S. PATENT DOCUMENTS

| | | | |
|---|---|---|---|
| 4,508,086 | 4/1985 | Ito et al. | 123/492 |
| 4,534,331 | 8/1985 | van Belzen et al. | 123/492 |
| 4,633,839 | 1/1987 | Yasuoka et al. | 123/488 |
| 4,858,136 | 8/1989 | Tanaka et al. | 123/492 X |
| 4,951,634 | 8/1990 | Nishizawa et al. | 123/492 |
| 4,962,742 | 10/1990 | Nishizawa et al. | 123/492 |
| 4,984,552 | 1/1991 | Nishizawa et al. | 123/492 |

*Primary Examiner*—Willis R. Wolfe

*Attorney, Agent, or Firm*—Sughrue, Mion, Zinn, Macpeak and Seas

[57] ABSTRACT

A fuel control device of an engine which comprises: an intake pipe pressure detecting means; a crank angle signal generating means; a transient state determining means for determining a transient state of an engine; a transient state correction fuel quantity calculating means; an averaging means for averaging the pressure data in a predetermined crank angle signal period; a basic fuel quantity selecting and calculating means for calculating a basic fuel quantity after selecting an output signal of an instantaneous value of the pressure data or an output signal of the averaging means corresponding with an output level of the transient state correction fuel quantity calculating means; a fuel injection quantity determining means for calculating a fuel injection quantity by using the transient state correction fuel quantity and the basic fuel quantity; a fuel quantity measuring means for measuring a fuel quantity for supplying by injection fuel of the fuel injection quantity by the fuel injection quantity determining means to the engine synchronizing with a crank angle signal; a nonsynchronizing fuel quantity determining means for calculating a nonsynchronizing fuel quantity in detecting of an acceleration state of the engine by comparing an instantaneous value of the pressure data with an output signal of the averaging means; and a nonsynchronizing fuel quantity measuring means for measuring a fuel quantity for supplying by injection fuel of the nonsynchronizing fuel quantity by the nonsynchronizing fuel quantity determining means to the engine not synchronizing with the crank angle signal.

1 Claim, 8 Drawing Sheets

FUEL CONTROL DEVICE OF AN ENGINE

BACKGROUND OF THE INVENTION

1. Field of the Invention

This invention relates to a fuel control device of an engine which controls quantity of fuel that is supplied to an engine of an automobile or the like.

2. Discussion of the Background

In the conventional device of this kind, pressure in an intake pipe of an engine is detected by an intake pipe pressure detecting means which is converted to a pressure data. Determination is made whether the engine is in transient state, by comparing the pressure data and a threshold value for determining a transient state. Corresponding with a result of the determination, the fuel injection quantity is calculated based on the pressure data. The fuel of this fuel injection quantity is simultaneously supplied by injection to the engine synchronizing with a predetermined crank angle. The acceleration state of the engine is swiftly detected by detecting the change quantity of an output of a throttle opening degree sensor. The fuel is simultaneously supplied to the engine not synchronizing with the crank angle.

Since the conventional fuel control device of an engine is constructed as above, a ripple variation of the pressure data is significant when the engine load is in heavy load range. Therefore the threshold value for determining a transient state is set at high value considering the ripple variation so that the transient state is not erroneously detected by the ripple variation. Henceforward, the detection sensitivity is lowered. Especially in the acceleration time of the engine in its light load range, although it is possible to control the nonsynchronizing injection by a throttle opening degree sensor at an initial state of the acceleration, the transient state detection for increasing the synchronized injection quantity is retarded. Therefore it is not possible to supply the fuel quantity in correspondence with the transient state to the engine with high response. The air-furl ratio control in the transient time is delayed, and the air-fuel ratio becomes unstable, which worsens the running performance of the engine. Furthermore, since the conventional system utilizes the throttle opening degree sensor, the cost for the control device is increased.

SUMMARY OF THE INVENTION

It is an object of the present invention to provide a fuel control device of an engine capable of stabilizing the air-fuel ratio, having a high response in the transient state, without utilizing the throttle opening degree sensor.

According to an aspect of the present invention, there is provided a fuel control device of an engine which comprises: a intake pipe pressure detecting means for detecting an intake pipe pressure and converting the intake air pressure to a pressure data; a crank angle signal generating means for generating a crank angle signal which is synchronized with a predetermined crank angle; a transient state determining means for determining a transient state of an engine by comparing a timewise change quantity of the pressure data with a threshold value for determining the transient state which is selected corresponding with a load state of the engine; a transient state correction fuel quantity calculating means for calculating a transient state correction fuel quantity based on the pressure data when the transient state of an engine is determined; an averaging means for averaging the pressure data in a predetermined crank angle signal period; a basic fuel quantity selecting and calculating means for calculating a basic fuel quantity after selecting an output signal of an instantaneous value of the pressure data or an output signal of the averaging means corresponding with an output level of the transient state correction fuel quantity calculating means; a fuel injection quantity determining means for calculating a fuel injection quantity by using the transient state correction fuel quantity and the basic fuel quantity; a fuel quantity measuring means for measuring a fuel quantity for supplying by injection fuel of the fuel injection quantity by the fuel injection quantity determining means to the engine synchronizing with a crank angle signal; a nonsynchronizing fuel quantity determining means for calculating a nonsynchronizing fuel quantity in detecting of an acceleration state of the engine by comparing an instantaneous value of the pressure data with an output signal of the averaging means; and a nonsynchronizing fuel quantity measuring means for measuring a fuel quantity for supplying by injection fuel of the nonsynchronizing fuel quantity by the nonsynchronizing fuel quantity determining means to the engine not synchronizing with the crank angle signal.

Figure 1:
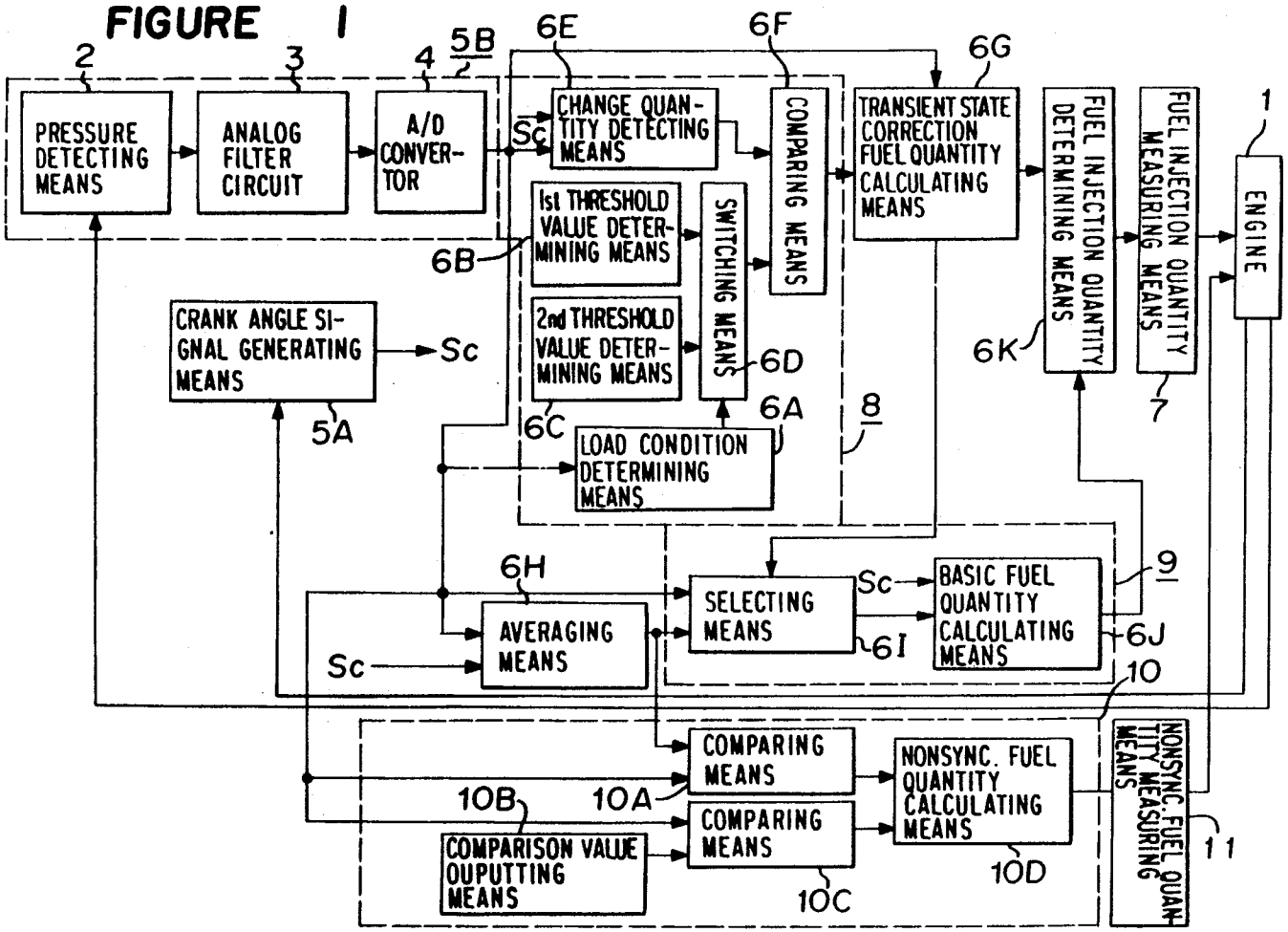
FIG. 1 is a construction diagram of the invented device.

In the drawings, a numeral 1 designates an engine, 5A, a crank angle signal generation means, 5B, an intake pipe pressure detecting means, 6G, a transient state correction fuel quantity calculating means, 6H, an averaging means, 6K, a fuel injection quantity determining means, 7, a fuel quantity measuring means, 8, a transient state determining means, 9, a basic fuel quantity selection calculating means, 10, a nonsynchronizing fuel quantity determining means, 11, nonsynchronizing fuel quantity measuring means, 20, an injector, 25, a crank angle sensor, 28, a pressure sensor, and 32, an ECU.

The same notation in the drawings designates the same or the corresponding parts.

DETAILED DESCRIPTION OF THE PREFERRED EMBODIMENTS

In the followings, explanation will be given to embodiments of the present invention referring the drawings. FIG. 1 shows a construction of an embodiment of the fuel control device of the engine. In FIG. 1, a numeral 1 designates a publicly known engine which is mounted on an automobile, 2, a pressure detecting means for detecting a pressure in an intake pipe of the engine 1, 3, an analogue filter circuit for decreasing a ripple of an output signal of the pressure detecting means 2, 4, an A/D converter for converting an output signal of the analogue filter circuit 3 to a digital value, 5A, a crank angle signal generating means for generating a crank angle signal $S_c$ at every predetermined crank angle of the engine 1, 5B, an intake pipe pressure detecting means which is constituted by constituent elements of numerals 2 to 4, and which detects an intake pipe pressure of the engine 1, and which converts it to a digital pressure data as an output. A notation 6A designates a load condition determining means for determining a state (for instance whether larger than or equal to a predetermined value) of the load of the engine 1 (for instance, the output signal of the intake pipe pressure detecting means 5B or the like), 6B, a first threshold value output means for outputting a threshold value for determining the first transient state which is utilized for transient state determination in low load of the engine, 6C, a second threshold value output means for outputting a threshold value for determining a second transient state, the value of which is larger than the threshold value for determining the first transient state, 6D, a switching means for switching and outputting one of the outputs of the first and second threshold value output means 6B and 6C, corresponding with the result of the determination of the load condition determining means 6A. A notation 6E designates a change quantity detecting means for detecting a change quantity of an output signal of the intake pipe pressure detecting means 5B in a period, for instance, the one based on the crank angle signal $S_c$, 6F, a comparing means for detecting the state of engine as a transient state when an output signal of the change quantity detecting means 6E is equal to or more than a threshold value for transient state determination which is outputted from the switching means 6D, 6G, a transient state correction fuel quantity calculating means for calculating a transient state correction fuel quantity based on an output signal of the intake pipe pressure detecting means 5B after receiving a transient state detecting signal of the comparing means 6F, 6H, an averaging means for averaging an output signal of the intake pipe pressure detecting means 5B in a period of a predetermined crank angle signal $S_c$, 6I, a selecting means for selecting and outputting one of the output signals of the intake pipe pressure detecting means 5B and the averaging means 6H, corresponding with an output level of the transient state correction fuel quantity calculating means 6G, 6J, a basic fuel quantity calculating means for calculating a basic fuel quantity by inputting the output signal of the selection means 6I and the crank angle signal $S_c$, 6K, a fuel injection quantity determining means for determining a fuel injection quantity in a drive pulse width of the injector, utilizing output signals of the transient state correction fuel quantity calculating means 6G and the basic fuel quantity calculating means 6J, and 7, a fuel quantity measuring means, which measures and supplies by injection the fuel corresponding with a fuel injection quantity calculated by fuel injection quantity determining means 6K, to the engine, synchronizing with a predetermined crank angle. A numeral 8 designates a transient state determining means composed of the constituent elements of 6A through 6F, which determines the transient state of the engine by comparing the threshold value for determining the transient state that is selected according to the load condition of the engine, and the change quantity of the output signal of the intake pressure detecting means 5B in the period, for instance, the one based on the crank angle signal $S_c$. A numeral 9 designates a basic fuel quantity calculating means which is composed of the constituent elements of the parts 6I and 6J, which calculates the basic fuel quantity from a signal selected from output signals of intake pipe pressure detecting means 5B and the averaging means 6H corresponding with an output level of the transient state correction fuel quantity calculating means 6J, and the crank angle signal $S_c$. A notation 10A designates a comparing means which compares the output signals of the intake pipe pressure detecting means 5B with the averaging means 6H, and detects an acceleration state of the engine 1, 10B, a comparison value outputting means which determines a comparison value for determining whether the acceleration state continues, after the comparing means 10A detects the acceleration state, 10C, a comparing means which detects the continued acceleration state by comparing the output signals of the comparison value outputting means 10B with the intake pipe pressure detecting means 5B, and 10D, a nonsynchronizing fuel quantity calculating means for calculating a nonsynchronizing fuel injection quantity when the comparison means 10A and 10C detect the acceleration state. The nonsynchronizing fuel quantity detecting means 10 is composed of the constituent elements of 10A through 10D. A numeral 11 designates a nonsynchronizing fuel quantity measuring means which measures and supplies by injection the fuel corresponding with the fuel injection quantity which is calculated by the nonsynchronizing fuel quantity determining means 10, to the engine 1 not synchronizing with the crank angle.

Figure 2:
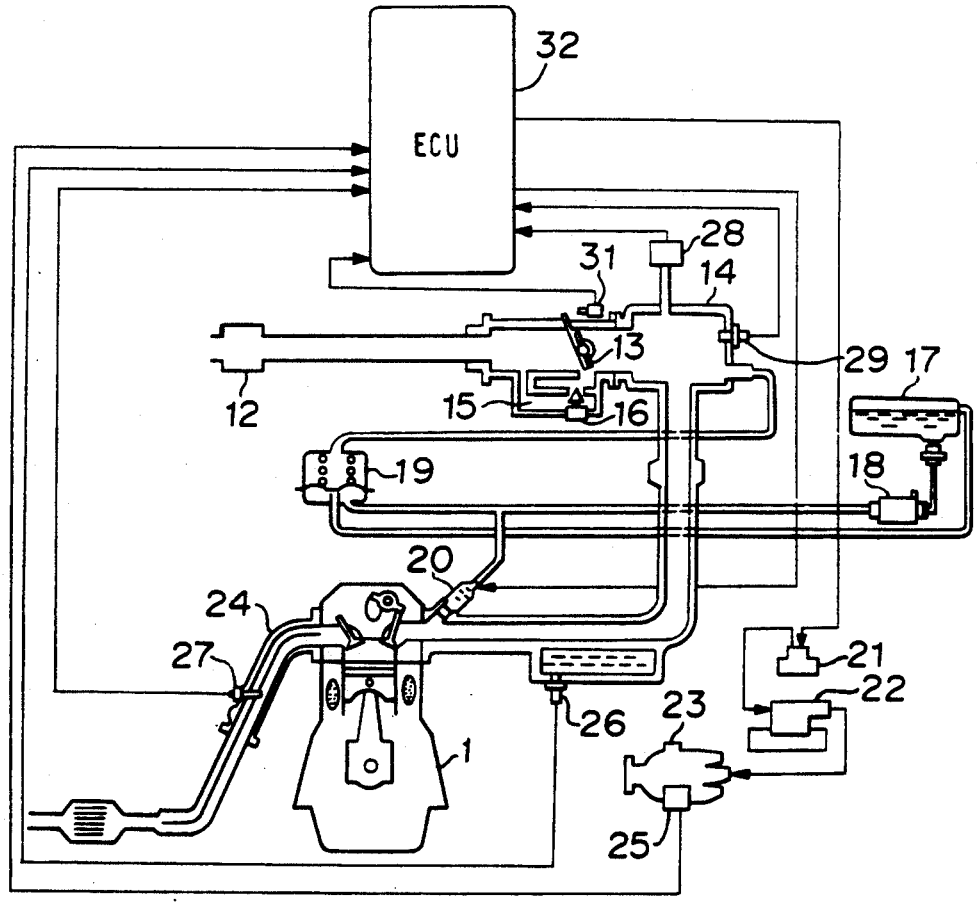
FIG. 2 is a construction diagram of an engine unit according to the present invention.

FIG. 2 shows a construction of the embodiment of the engine unit. A numeral 1 designates, for instance, a publicly known four-cycle three-cylinder engine which is mounted on the vehicle such as an automobile. The air for combustion is sucked to the engine successively through the air cleaner 12, the throttle valve 13, and the surge tank 14. In idling time of the engine, the throttle valve 13 is closed. The opening degree of the bypass passage 15 which bypasses the throttle valve 13, is controlled by the thremo-wax type first idle valve 16. The air for combustion having a quantity corresponding with the opening degree is supplied to the engine 1. Furthermore, the fuel which is fed from the fuel tank 17 by the fuel pump 18, the pressure of which is controlled to a predetermined injection pressure by the fuel pressure regulator 19, is supplied to the engine by simultaneous injection through the injectors 20 which are provided corresponding with the respective cylinders of the engine 1. Furthermore the ignition signal at ignition time is successively supplied to ignition plugs (not shown) which are provided at the respective cylinders of the engine 1, successively through the ignition drive circuit 21, the ignition coil 22 and the distributor 23. The exhaust gas after combustion is exhausted to the air through the exhaust manifold 24 or the like. A numeral 25 designates a crank angle sensor which detects a rotation speed of a crank shaft of the engine 1, which generates a crank angle signal composed of a frequency pulse signal in correspondence with the rotation speed, that, for instance, rises at BTDC 70°, and falls at TDC. A numeral 26 designates a cooling water temperature sensor which detects a cooling water temperature, and 28, a pressure sensor, installed at the surge tank 14, which detects the pressure in the intake pipe in absolute pressure, and outputs a pressure detection signal the size of which corresponds with the intake pipe pressure. A numeral 29 designates an intake air temperature sensor which is installed at the surge tank 14, and which detects a temperature of the intake air, 27, an air-fuel ratio sensor which is installed at the exhaust manifold 24, and detects oxygen concentration of the exhaust gas, and 31, an idle switch which detects that the throttle valve 13 is closed in idling time of the engine. The respective detected signals of the respective sensors 25 through 29 and the idle switch 31 are fed to an electronic control unit (hereinafter, ECU). The ECU 32 determines the fuel injection quantity corresponding with the transient state of the engine based on these detected signals, controls the fuel injection quantity by controlling a valve opening time for the injector 20, and controls the drive of the ignition drive circuit 21.

Figure 3:
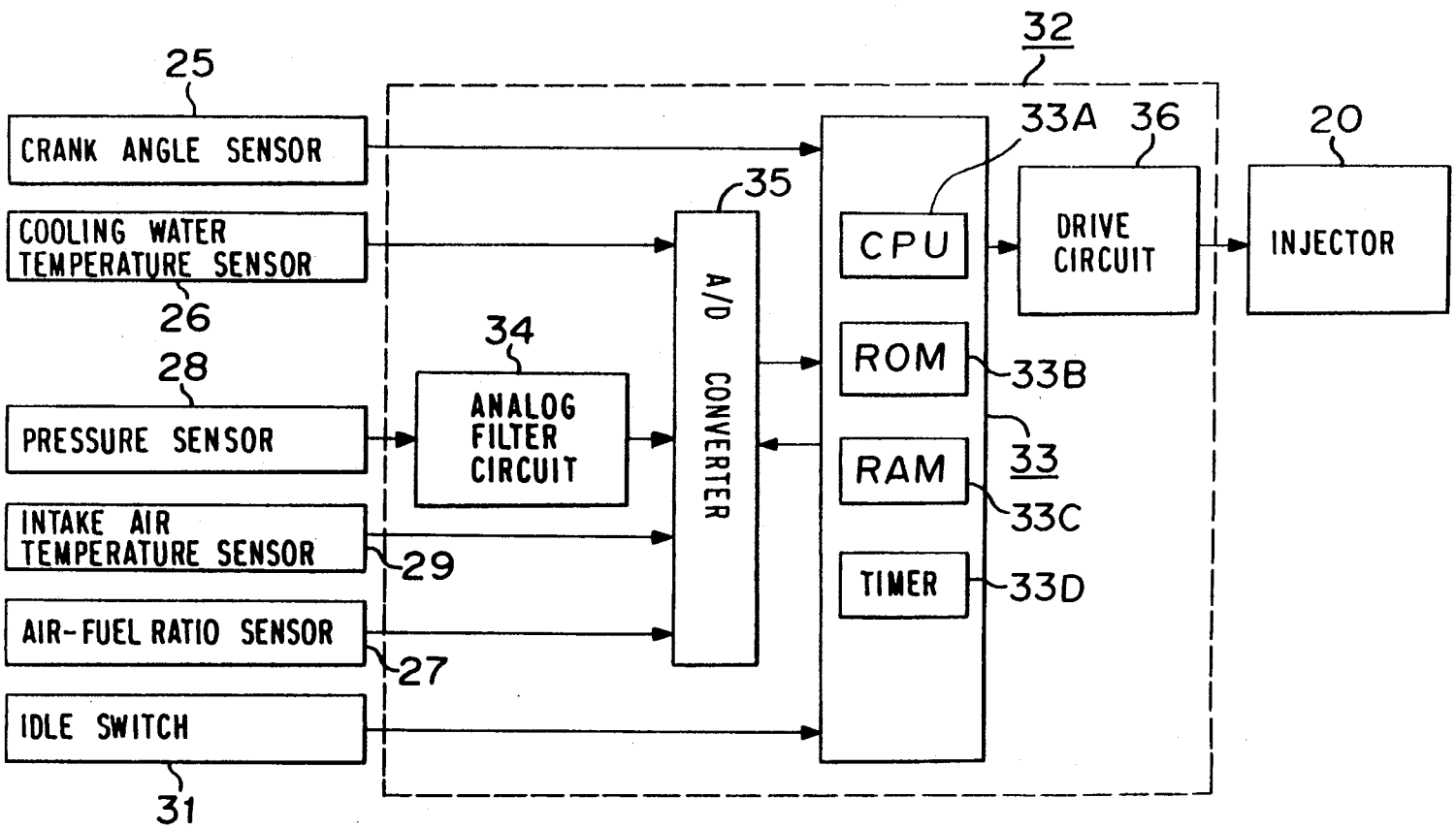
FIG. 3 is a construction diagram of ECU according to the present invention.

FIG. 3 shows a detailed construction of the ECU 32. ECU 32 is composed of the microcomputer 33 which performs the various calculations or determinations, the analogue filter circuit 34 which decreases the ripple of the pressure detection signal of the pressure sensor 28, the A/D convertor 35 which successively converts the analogue detection signal of the intake air temperature sensor 29, the cooling water temperature sensor 26, the air-fuel ratio sensor 27 and the output signal of the analogue filter circuit 34, and the drive circuit 36 which drives the injector 20, or the like. As for the output unit of the ECU, only the fuel control unit is shown in the diagram. Furthermore, the input port of the microcomputer 33 is connected to the output terminals of the crank angle sensor 25, the idle switch 31, and the A/D convertor 35. The output port of the microcomputer 33 is connected to the A/D convertor 35 for sending out reference signals, as well as to an input terminal of the drive circuit 36. Furthermore, the microcomputer 33 is composed of the CPU 33A which performs various calculations or determinations, the ROM 33B which stores the programs for the flows described in FIGS. 5 to 8, the ROM 33C as a work memory, and the timer 33D which presets the valve opening time of the injector 20.

Figures 4A, 4B, 4C:
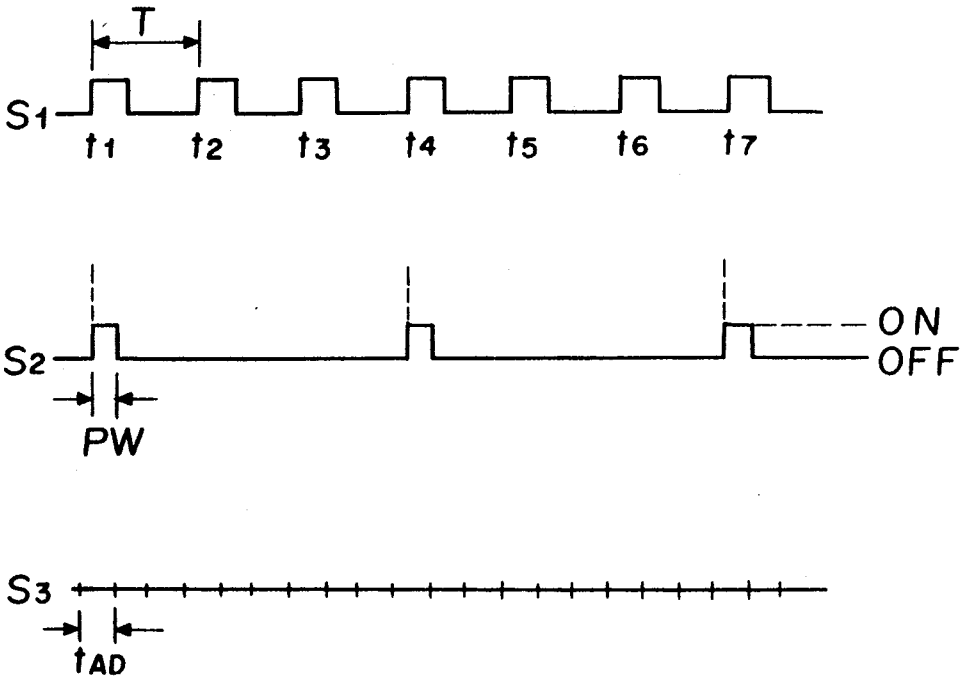
FIGS. 4A through 4C are signal timing charts of the respective parts of the invented device.

FIGS. 4A to 4C are timing charts which shows the operation of the various parts in FIG. 3. As shown in FIG. 4A, the crank angle signal $S_1$ which is an output signal of the crank angle sensor 25, rises at time points $t_1$ to $t_7$. The period T between the successive rise points varies with the rotation speed of the engine 1. The drive pulse signal of the injector 20 is generated once per every three generations of the crank angle signal $S_1$ (which corresponds with the three cylinders of the engine 1), by which fuel injection is performed simultaneously for the three cylinders. The A/D conversion timing $S_3$ at which the A/D convertor 35 converts the pressure detection signal of the pressure sensor 28 that is inputted through the analogue filter circuit 34, into the pressure data, is as shown in FIG. 4C. A plurality of the timing periods $t_{AD}$ are included in a duration of time between successive injections, and are always constant (for instance 2.5 msec).

Figure 5:
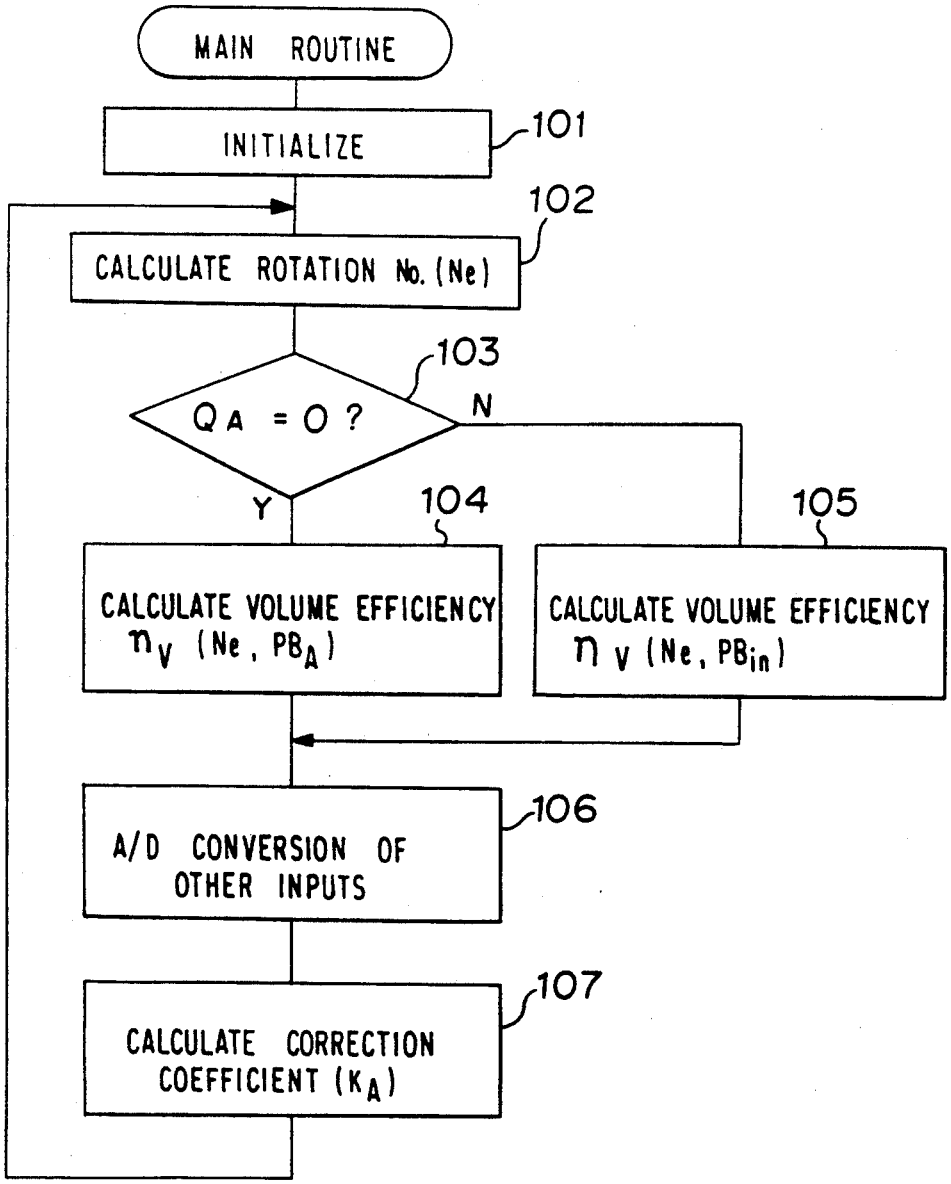
FIGS. 5 through 7 are flow charts showing the operation of CPU in ECU according to the present invention.

Next, explanation will be given to the operation of the CPU 33A in the ECU 32 referring FIGS. 2 to 8. First of all, when power source is ON, the main routine shown in FIG. 5 is initiated. In step 101, the operation is initialized by clearing the content of the RAM 33C and the like. In step 102, the operation reads out the measured value of the period T of the crank angle signal $S_1$, and performs the calculation of the rotation number Ne, the result of which is stored in the RAM 33C. In step 103, the operation determines whether the increased fuel quantity $Q_A$, mentioned later, which is read from the RAM 33C, is 0. If $Q_A$ is 0, in step 104, the operation reads out the revolution number Ne and the average value of the pressure data $PB_A$, mentioned later, from the RAM 33C, and based on these values, calculates by mapping from the ROM 33B, the volume efficiency $\eta_v$ (Ne, $PB_A$) which is experimentally obtained beforehand, so that the air-fuel ratio becomes a predetermined value (for instance a theoretical air-fuel ratio), the result of which is stored in the RAM 33C. When $Q_A \neq 0$, in step 105, the operation reads out the revolution number Ne and the pressure data PB in the RAM 33C, and based on these values, the operation calculates the volume efficiency $\eta_v$ (Ne, $PB_{in}$), the result of which is stored in the RAM 33C. In step 106, the operation successively A/D converts the respective detected signals of the cooling water sensor 20, the intake air temperature sensor 29 and the air-fuel ratio sensor 27, the result of which is stored in the RAM 33C. In step 107, the operation successively reads out the cooling water temperature data, the intake air temperature data and the air fuel ratio data from the RAM 33C, and calculates the correction coefficient $K_A$ for correcting the basic fuel quantity, the result of Which is stored in the RAM 33C. In this correction coefficient $K_A$, all of the correction coefficients such as the warming-up correction coefficient which corresponds with the cooling water temperature, the intake air temperature correction coefficient which corresponds with the intake air temperature, the air-fuel ratio feed back signal and the like, are combined. After the treatment of step 107, the operation returns to step 102, and the above successive operation is iterated.

Figure 6:
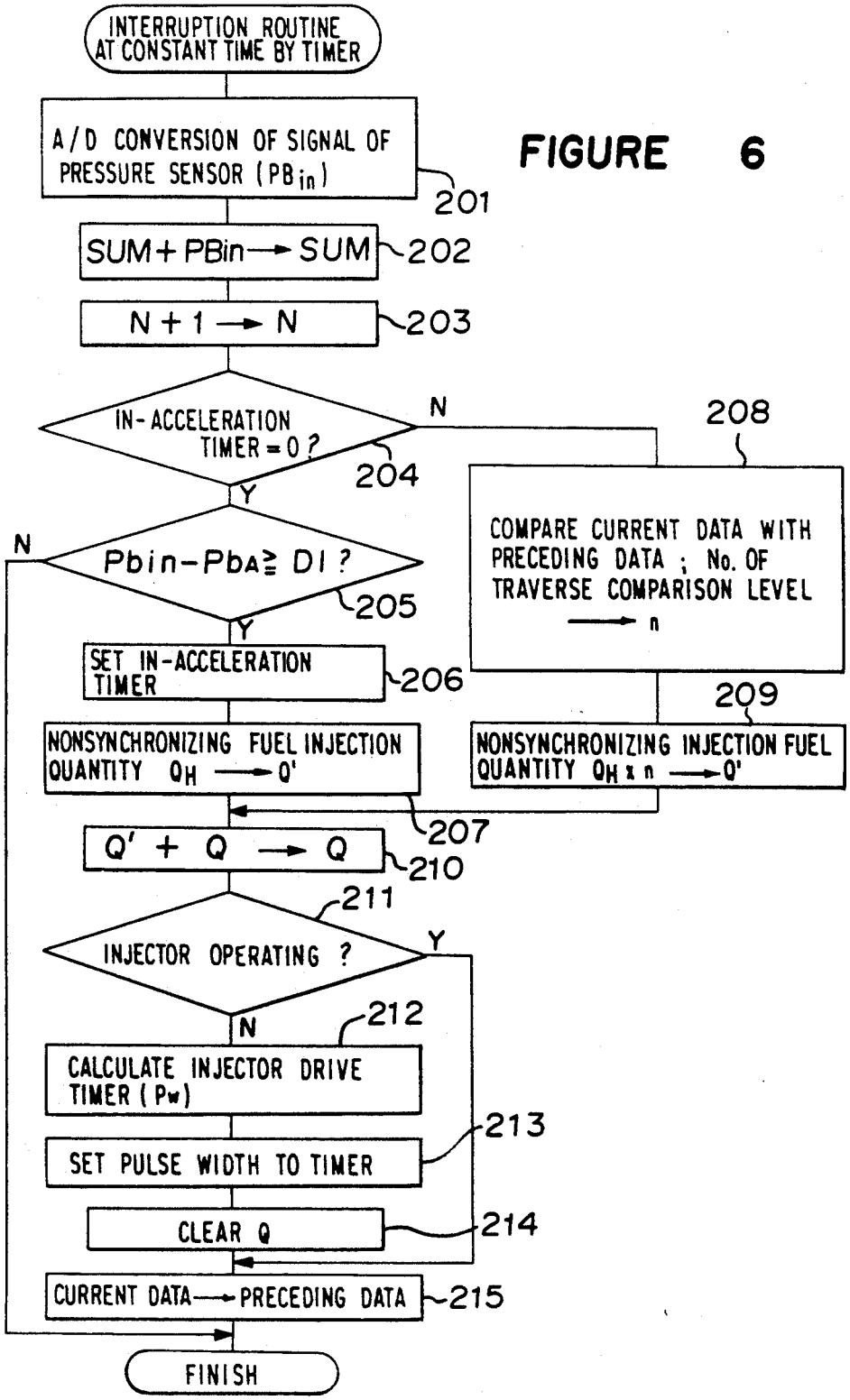

On the other hand, an interruption signal is generated at every elapse of the A/D conversion timing period $t_{AD}$, and the operation treats the interruption routine shown in FIG. 6. In step 201, the operation A/D converts the output signal of the pressure sensor 28 which passed through the analogue filter circuit 34, to the digital pressure data $PB_{in}$ by using the A/D convertor 35. In step 202, the operation adds a new pressure data $PB_{in}$ to the summation value (SUM) of the pressure data, and a new summation value of the pressure data and the pressure data $PB_{in}$ are stored and renewed in the RAM 33C. In step 203, the operation adds 1 to the addition number N by which addition number N is renewed and stored in the RAM 33C. In step 204, the operation determines whether an in-acceleration timer, not shown, which is set in step 206, mentioned later and which is subtracted at every predetermined time, is 0. If N is 0, that is, after a predetermined time elapses after the detection of the acceleration, the operation goes to step 205. In step 205, the operation determines whether the difference between the A/D transformed pressure data $PB_{in}$ and the average value of the pressure data $PB_A$, mentioned later, is more than or equal to the dead zone data $D_1$. When the difference falls in the dead zone, the operation is finished. When the difference is equal to or more than the dead zone, the operation determines that the engine is in acceleration, and goes to step 206. In step 206, the operation sets the in acceleration timer which shows that the engine is in acceleration, to a predetermined value. In step 207, the operation calculates the nonsynchronizing fuel injection quantity $Q_H$ which is to be injected this time, as Q', which is stored in the RAM 33C. In step 210, the operation adds the currently calculated nonsynchronizing fuel injection quantity Q' to the nonsynchronizing fuel injection quantity Q which is not injected when the operation proceeds from step 211 to step 215 in the preceding cycle, and the nonsynchronizing fuel injection quantity Q is renewed. In step 211, the operation determines whether the injector 20 is operating at the simultaneously injection or the like. When the injector is operating, the operation goes to step 215. When the injector is not operating, the operation goes to step 212, reads out the fuel quantity versus drive time conversion coefficient $K_{INJ}$ of the injector 20, and the dead time $T_D$, and performs a Calculation of $PW=Q\times K_{INJ}+T_D$, by which the injector drive time PW is calculated. In step 213, the operation sets this injector drive time PW to the timer 33D, by which the timer 33D is operated for the injector drive time PW. During the operation of the timer 33D, the injector drive pulse signal $S_2$ is applied to the injector 20 through the drive circuit 36. During that period fuel is supplied by injection from the injector 20 to the engine 1. In step 214, the operation clears the nonsynchronizing fuel injection quantity Q. In step 215, the operation makes the pressure data which is A/D-converted in step 201, a preceding pressure data, and the interruption routine of FIG. 6 is finished. On the other hand, when the in-acceleration timer is not 0 in step 204, that is, when the time falls in the predetermined time after the detection of the acceleration of the engine, the operation goes to step 208. In step 208, the operation always determines whether the pressure data traverses the set values (1) to (3), and detects the number of time n of traversing the set values at every determination. In step 209, the operation calculates the nonsynchronizing fuel injection quantity which corresponds with the number of time n detected at step 208, by the equation of $Q_H\times n=Q'$, and goes to step 210.

Figure 7:
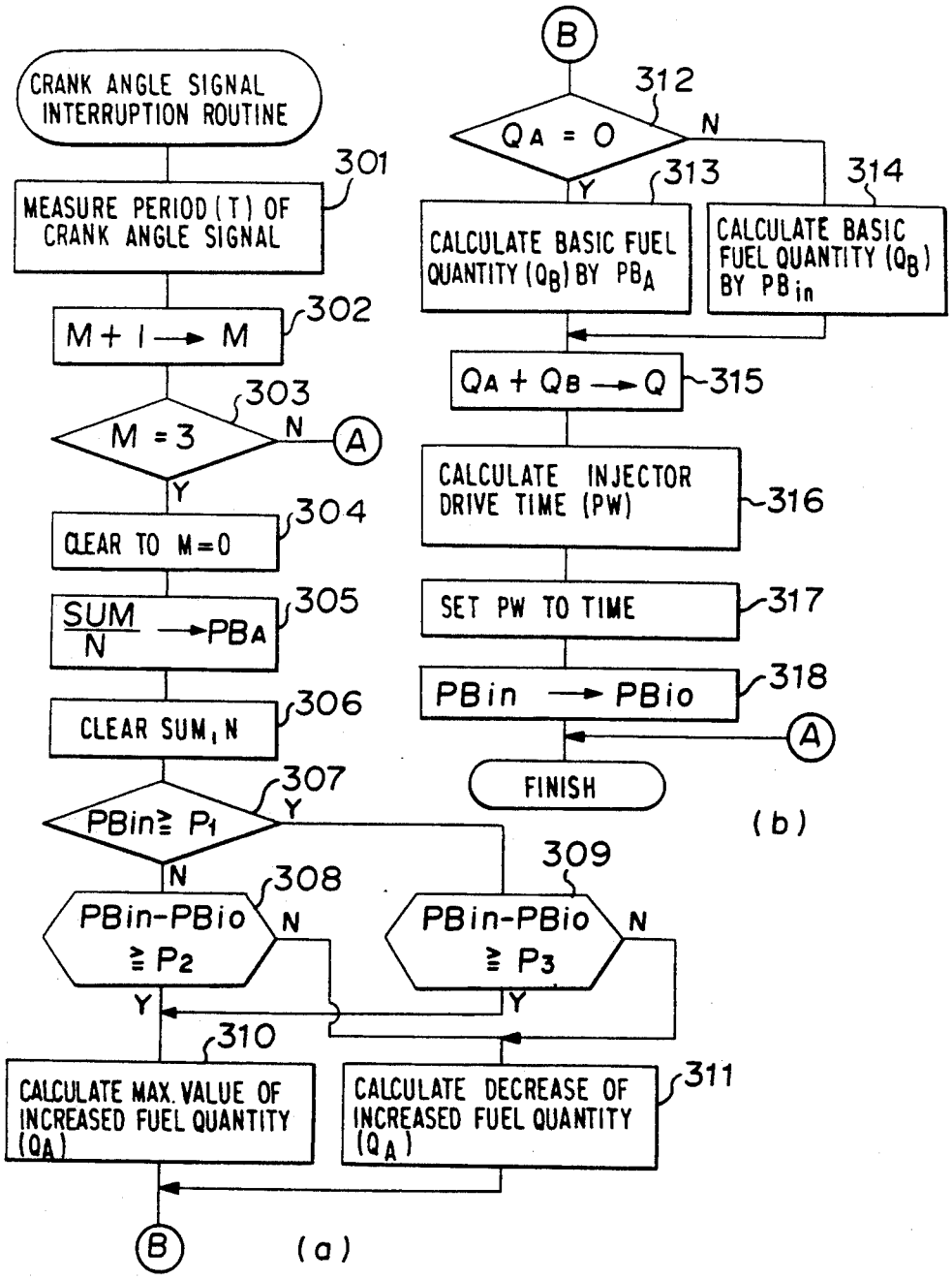
Figure 8:
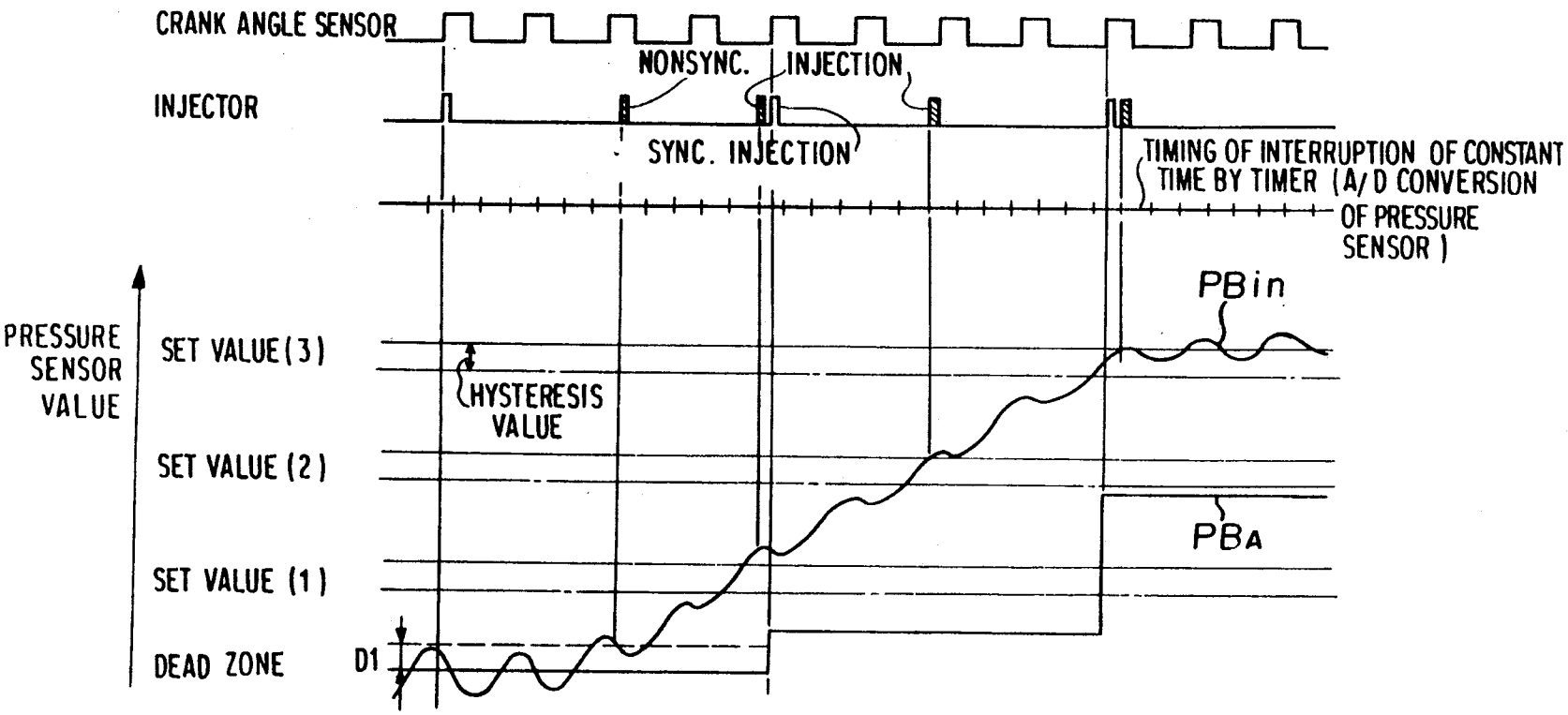
FIG. 8 is a timing chart of a nonsynchronizing injection of the invented device.

Furthermore, the crank angle interruption signal is generated at every rise of the crank angle signal $S_1$ of the crank angle sensor 25, and the operation treats the crank angle signal interruption routine shown in FIG. 7. In step 301, the measured value of the period T of the crank angle signal $S_1$ is stored in the RAM 33C. Measurement of the period T is performed by for instance, a software timer or a hardware timer in the computer 33. In step 302, the operation adds 1 to the number of generation M of the crank angle signal $S_1$ by which the number of generation M is renewed. In step 303, the operation determines whether the number of the generation of the crank angle signal M is 3. When the number of generation is below 3, the number of generation M is stored in the RAM 33C, and a series of treatments are finished. When the number of generation M=3, in step 304, the operation clears the number of generation M as 0. In step 305, the summation value of the pressure data SUM is divided by the number of addition N, and obtains the average value of the pressure data $PB_A$ in a single period of the fuel injection, which is stored in the RAM 33C. This average value of the pressure data $PB_A$ signifies an average value of the intake pipe pressure during the single period of the fuel injection. In step 306, the summation value of the pressure data 3 and the number of addition are cleared as 0. In step 307, the operation determines whether the pressure data $PB_{in}$ which is obtained just before the current fuel injection, that is, just before the rise of the current pulse when the crank angle signal $S_1$ synchronizes with the fuel injection, is equal to or more than the first predetermined value $P_1$ which corresponds with the first predetermined pressure. When $PB_{in}$ is below $P_1$, the operation goes to step 308. When $PB_{in}$ is equal to or more than $P_1$, the operation goes to step 309. In step 308, the operation determines whether the deviation $\Delta PB_i$ between the pressure data $PB_{in}$ and the pressure data $PB_{io}$ which is obtained just before the preceding fuel injection, that is, just before the rise of the preceding pulse when the crank angle signal $S_1$ is synchronized with the fuel injection, is equal to or more than the second predetermined value $P_2$ which corresponds with the second predetermined pressure. When $\Delta PB_i$ is equal to or more than $P_2$, the operation goes to step 310. When $\Delta PB_i$ is below $P_2$, the operation goes to step 311. On the other hand, in step 309, the operation determines whether the deviation $\Delta PB_i=\Delta PB_{in}-PB_{io}$ which is obtained by the same way with that in step 308, is equal to or more than the third predetermined value $P_3$ ($P_3>P_2$) which corresponds with the third predetermined pressure. When $\Delta PB_i$ is equal to or more than $P_3$, the operation goes to step 310. When $\Delta PB_i$ is below $P_3$, the operation goes to step 311. In step 310, the operation calculatesd a new increased fuel quantity $Q_A$ by multiplying the deviation $\Delta PB_i$ by a constant, and compares the result of the calculation with increased fuel quantity $Q_A$ which is already stored in the RAM 33C, and stores a larger value in the RAM 33C. On the other hand, in step 311, The operation subtracts a predetermined value $\alpha$ from the increased fuel quantity $Q_A$ which is read out from the RAM 3C. When the calculated value becomes minus, the value is clipped to 0. By such method, $Q_A$ is renewed by performing subtraction calculation of the increased fuel quantity $Q_A$. The operation goes to step 312 after step 310 or 311, and determines whether the increased fuel quantity $Q_A$ is 0, and stores $Q_A$ to the RAM 33C. When $Q_A$ is 0, the operation determines that the engine is not in the transient state correction period, and goes to step 313 If $Q_A$ is not 0, the operation determines that the engine is in the transient state correction period, and goes to step 314. In step 313, the operation reads out the correction coefficient $K_A$, the volume efficiency $\eta_v$(Ne, $PB_A$) and the average value of the pressure data $PB_A$ from the RAM 33C, and reads out the pressure versus fuel exchange coefficient from the ROM 33B, and calculates the basic fuel quantity $Q_B$ by performing the calculation of $Q_B=K_Q\times K_A\times\eta_v$ (Ne, $PB_A$)$\times PB_A$. On the other hand, in step 314, similar to step 313, the operation calculates the basic fuel quantity by using the pressure data $PB_{in}$, according to the calculation equation of $Q_B=K_Q\times K_A\times\eta_v$(Ne, $PB_{in}$)$\times PB_{in}$. The operation goes to step 315 after step 313 or 314, where the operation calculates the supply fuel quantity Q by adding the increased fuel quantity $Q_A$ to the basic fuel quantity $Q_B$. In step 316, The operation reads out the fuel quantity versus drive time exchange coefficient $K_{INJ}$ of the injector 20 and the dead time $T_D$ from the ROM 33B, and calculates the injector drive time PW as the fuel injection quantity, by performing the calculation of $PW=Q\times K_{INJ}+T_D$. In step 317, the operation sets the injector drive time PW to the timer 33D, and operates the timer 33D during the period of PW. During the operation of the timer 33D, injector drive pulse signal $S_2$ is supplied to the injector 20 through the drive circuit 36, and fuel is supplied by injection from the injector 20 to the engine 1. In step 318, The operation renews $PB_{io}$ by replacing the pressure data $PB_{in}$ which is obtained just before the current fuel injection, with a pressure data $PB_{io}$ which is obtained just before the preceding fuel injection, and the interruption treatment of FIG. 7 is finished.

Furthermore, in the above respective embodiments, for instance, in the neighborhood of the maximum revolution number, a total ripple suppressing ratio is obtained by combining a ripple suppressing ratio of the averaging of the pressure data in the averaging program treatment during a single period of the fuel injection, and the ripple suppressing ratio of the analogue filter circuit 34. The ripple suppressing ratio of the analogue filter circuit 34 is selected so that the response necessary for determining the increase or the decrease of signals, is obtained, and the ripple is suppressed to an extent in which an erroneous determination is not made. By suitably selecting the attenuation property of the analogue filter circuit 34 and the A/D conversion timing period $t_{AD}$, the total ripple suppressing ratio is controlled under a predetermined value, and the influence of the ripple which accompanies the supply fuel quantity Q, can sufficiently be decreased. Furthermore, as a crank angle signal, the ignition pulse signal on the primary side of the ignition coil 22, can be utilized. In this invention, the ignition pulse signal is a regarded to generate at every predetermined crank angle.

As stated above, according to the present invention, the transient state of the engine is detected by comparing the change quantity of the pressure data of the intake pipe pressure with a threshold value for determining of transient state of the engine which is selected corresponding with the load state of the engine. Furthermore this invention is constructed to calculate the transient state correction fuel quantity based on the pressure data by the above detection. Therefore, the transient state threshold value in the range of light load, can be smaller than that in the range of high load, which hastens the detection of the acceleration from the light load range which is frequently performed in the practical driving. Furthermore, in the initial state of the acceleration of the engine, since the fuel injection is performed in nonsynchronizing way based on the change of the pressure data, the air-fuel ratio in the transient state, can be stabilized in the total driving range, which promotes the driving performance. Since the throttle opening degree sensor is not utilized, a fuel control device of an engine excellent in cost performance, can be obtained.

What is claimed is:

1. A fuel control device of an engine which comprises:

a intake pipe pressure detecting means for detecting an intake pipe pressure and converting the intake air pressure to a pressure data;

a crank angle signal generating means for generating a crank angle signal which is synchronized with a predetermined crank angle;

a transient state determining means for determining a transient state of an engine by comparing a timewise change quantity of the pressure data with a threshold value for determining the transient state which is selected corresponding with a load state of the engine;

a transient state correction fuel quantity calculating means for calculating a transient state correction fuel quantity based on the pressure data when the transient state of an engine is determined;

an averaging means for averaging the pressure data in a predetermined crank angle signal period;

a basic fuel quantity selecting and calculating means for calculating a basic fuel quantity after selecting an output signal of an instantaneous value of the pressure data or an output signal of the averaging means corresponding with an output level of the transient state correction fuel quantity calculating means;

a fuel injection quantity determining means for calculating a fuel injection quantity by using the transient state correction fuel quantity and the basic fuel quantity;

a fuel quantity measuring means for measuring a fuel quantity for supplying by injection fuel of the fuel injection quantity by the fuel injection quantity determining means to the engine synchronizing with a crank angle signal;

a nonsynchronizing fuel quantity determining means for calculating a nonsynchronizing fuel quantity in detecting of an acceleration state of the engine by comparing an instantaneous value of the pressure data with an output signal of the averaging means; and a nonsynchronizing fuel quantity measuring means for measuring a fuel quantity for supplying by injection fuel of the nonsynchronizing fuel quantity by the nonsynchronizing fuel quantity determining means to the engine not synchronizing with the crank angle signal.

* * * * *